US009649872B2

(12) United States Patent
Koizumi et al.

(10) Patent No.: US 9,649,872 B2
(45) Date of Patent: May 16, 2017

(54) CHUCK BODY AND MECHANICAL PENCIL

(71) Applicant: MITSUBISHI PENCIL COMPANY, LIMITED, Tokyo (JP)

(72) Inventors: Yusuke Koizumi, Yokohama (JP); Kyo Nakayama, Yokohama (JP)

(73) Assignee: Mitsubishi Pencil Company, Limited, Tokyo (JP)

( * ) Notice: Subject to any disclaimer, the term of this patent is extended or adjusted under 35 U.S.C. 154(b) by 1 day.

(21) Appl. No.: 14/647,502

(22) PCT Filed: Dec. 11, 2013

(86) PCT No.: PCT/JP2013/083224

§ 371 (c)(1),
(2) Date: May 27, 2015

(87) PCT Pub. No.: WO2014/092123

PCT Pub. Date: Jun. 19, 2014

(65) Prior Publication Data

US 2015/0314632 A1 Nov. 5, 2015

(30) Foreign Application Priority Data

Dec. 11, 2012 (JP) ..... 2012-270592

(51) Int. Cl.
*B43K 21/22* (2006.01)
*B43K 21/16* (2006.01)

(52) U.S. Cl.
CPC ..... *B43K 21/22* (2013.01); *B43K 21/16* (2013.01)

(58) Field of Classification Search
CPC ..... B43K 21/16; B43K 21/22
See application file for complete search history.

(56) References Cited

U.S. PATENT DOCUMENTS 3,947,133 A * 3/1976 Kageyama ..... B43K 21/20 401/65
2009/0028626 A1 1/2009 Hokimoto et al.
2010/0322695 A1 12/2010 Ohsawa et al.

FOREIGN PATENT DOCUMENTS

| | | | |
|---|---|---|---|
| CN | 101977779 | A | 2/2011 |
| JP | 62-11684 | U | 1/1987 |
| JP | 2002-321493 | A | 11/2002 |
| JP | 2006-315283 | A | 11/2006 |
| JP | 2012-158092 | A | 8/2012 |

* cited by examiner

*Primary Examiner* — Jennifer C Chiang
*Assistant Examiner* — Bradley Oliver
(74) *Attorney, Agent, or Firm* — Foley & Lardner LLP

(57) ABSTRACT

The present invention is a chuck body (13) provided with: a hollow, substantially cylindrical fastener (11) having a tapered inner surface (13) in which the diameter of the hole gradually changes along the axial direction; and a chuck (21) having a divided end part (23) divided into two or three, the divided end part (23) having a tapered outer surface (24) that can enter or exit from the fastener (11) and that comes into contact with the tapered inner surface (13) of the fastener (11) when entering the fastener (11). When the divided end part (23) of the chuck (21) closes in the fastener (11) and holds the core (10), the angle of the tapered outer surface (24) of the chuck (21) relative to the center axis line of the chuck (21) is substantially identical to the angle of the tapered inner surface (13) of the fastener (11).

4 Claims, 9 Drawing Sheets

PRIOR ART

PRIOR ART

CHUCK BODY AND MECHANICAL PENCIL

CROSS-REFERENCE TO RELATED APPLICATIONS

This application is a National Stage application of PCT/JP2013/083224, filed Dec. 11, 2013, which claims priority from Japanese application JP 2012-270592, filed Dec. 11, 2012.

TECHNICAL FIELD

The present invention relates to a chuck member for feeding out and holding lead of a mechanical pencil. Furthermore, the present invention relates to a mechanical pencil which is provided with the chuck member.

BACKGROUND ART

To feed out and hold the lead of a mechanical pencil, in the past, a chuck member has been used. As shown in Japanese Patent Publication No. 2002-321493A, the chuck member is comprised of a chuck and a fastener (fastening ring). The fastener is a hollow substantially cylindrical shape and has a straight inner circumference in the axial line direction. The chuck is split at one end part in the longitudinal direction. The split end part of this chuck enables insertion and withdrawal to and from the fastener and has a tapered outer surface which contacts the inner surface of the fastener when inserted in the fastener. As shown in Japanese Patent Publication No. 2012-158092A, the material of the chuck is typically a metal or plastic.

If the biasing force of a spring causes a chuck to enter a fastener, the tapered outer surface of the chuck receives drag from the inner surface of the fastener, so the split end part of the chuck closes and holds the lead. At the time of writing, in addition to the biasing force of the spring, writing pressure is applied to the chuck through the lead, so the tapered outer surface of the chuck receives a further stronger drag from the inner surface of the fastener. For this reason, the lead is held by the chuck by a stronger holding force, so at the time of writing, the lead can be prevented from sliding back. Note that it is known that a similar advantageous effect can be obtained even by a configuration where the fastener has a tapered inner surface and the chuck has a straight outer surface.

SUMMARY OF INVENTION

Technical Problem

However, even in a state where the lead is held by the chuck, at the time of start of writing, the writing pressure causes the chuck to be pushed into the fastener together with the lead resulting in the lead sliding back into the tip. The amount of slide back is slight, but sometimes it causes an odd sensation of use to the user. For this reason, it is preferable to make the amount of slide back of the lead as close to zero as possible. Further, if an extremely strong writing pressure is applied to the lead, the lead which is held by the chuck slides with respect to the chuck making writing impossible. Furthermore as explained later in the explanation of the present invention, the force of the chuck holding the lead becomes local, so the lead sometimes fractures. This phenomenon may be called "biteoff" of the lead.

The amount of slide back, the holding ability, and the fracture resistance of the lead of the chuck member depend on the material and size of the chuck. A high rigidity metal chuck is known to have a smaller amount of slide back of the lead than a plastic chuck and to have a higher holding ability and fracture resistance of the lead than a plastic chuck. However, a metal chuck is more expensive in terms of cost of materials and cost of processing than a plastic chuck. For this reason, when using a metal chuck, it is difficult to provide an inexpensive mechanical pencil.

Further, it is also known that by enlarging the split end part of a plastic chuck which holds the lead, the amount of slide back, holding ability, and fracture resistance of the lead of a plastic chuck approaches the amount of slide back, holding ability, and fracture resistance of the lead of a metal chuck. However, a plastic chuck with a large outer shape cannot be used for a mechanical pencil with a multicolor mechanical refill or fine lead.

Therefore, the present invention has as its object the provision of a chuck member which, regardless of the material or size of the chuck, enables small slide back of the lead and high lead holding ability and fracture resistance.

Solution to Problem

In a first aspect of the present invention, there is provided a chuck member comprising a hollow substantially cylindrical shape fastener which has a tapered inner surface where a diameter of its hole gradually changes in an axial line direction and a chuck which has a split end part which is split into two or three sections, the split end part being able to be inserted into and withdrawn from the fastener and having a tapered outer surface which contacts the tapered inner surface of the fastener when entering into the fastener, wherein, when the split end part of the chuck closes inside the fastener and holds the lead, the angle of the tapered output surface of the check is equal to the angle of the tapered inner surface of the fastener with respect to the center axial line of the chuck. Note that "when the split end part of the chuck closes inside the fastener and holds the lead" means the state where the lead does not drop out of the chuck due to gravity when the axial line direction of the lead matches with the direction of gravity.

In the first aspect of the present invention, preferably the chuck is comprised of a plastic which has elasticity.

In the first aspect of the present invention, preferably the invention is configured so that both end parts of the tapered inner surface of the fastener in the axial line direction do not contact the tapered outer surface of the chuck.

In the first aspect of the present invention, preferably the invention is configured so that the both end parts of the fastener are away from the tapered outer surface of the chuck in the radial direction.

In a second aspect of the present invention, there is provided a mechanical pencil which is provided with a chuck member of one aspect of the present invention.

Advantageous Effects of Invention

According to the present invention, a chuck member which, regardless of the material or size of the chuck, enables small slide back of the lead and high lead holding ability and fracture resistance is provided.

Below, the present invention will be much more sufficiently understood from the attached drawings and the description of the preferred embodiments of the present invention.

DESCRIPTION OF EMBODIMENTS

Below, referring to the attached drawings, the present invention will be explained. Further, in the attached drawings, the same components are assigned the same reference notations.

Figure 1:
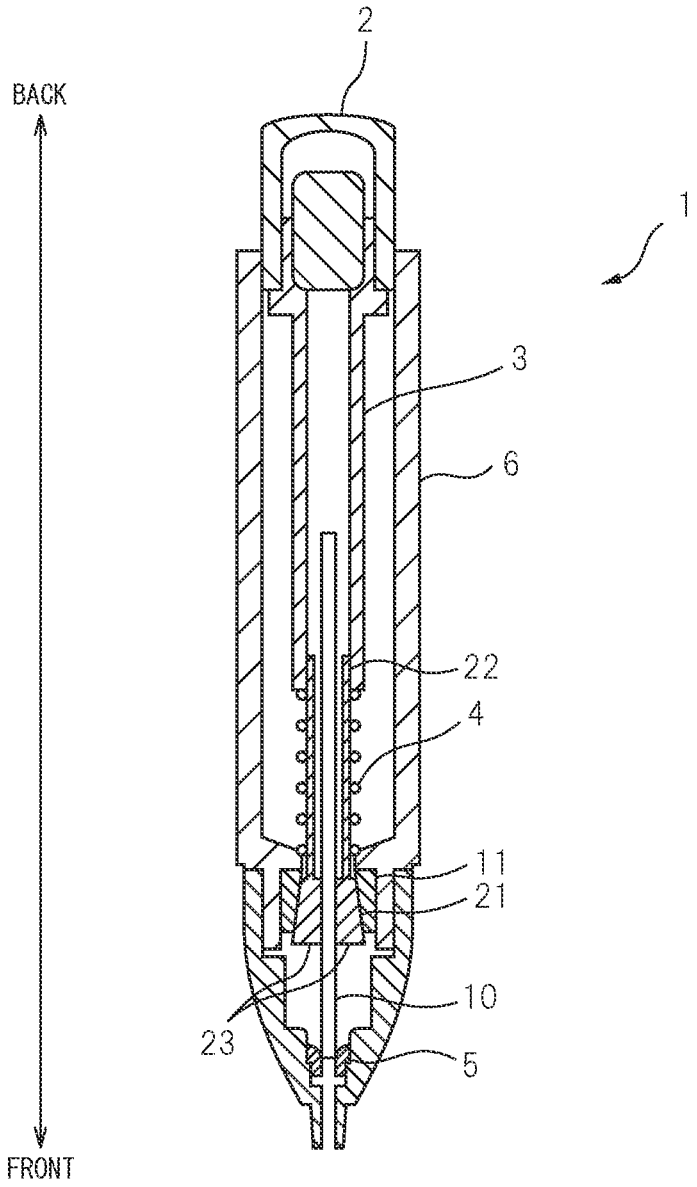
FIG. 1 is a side cross-sectional view of a mechanical pencil according to the present invention.
Figure 2:
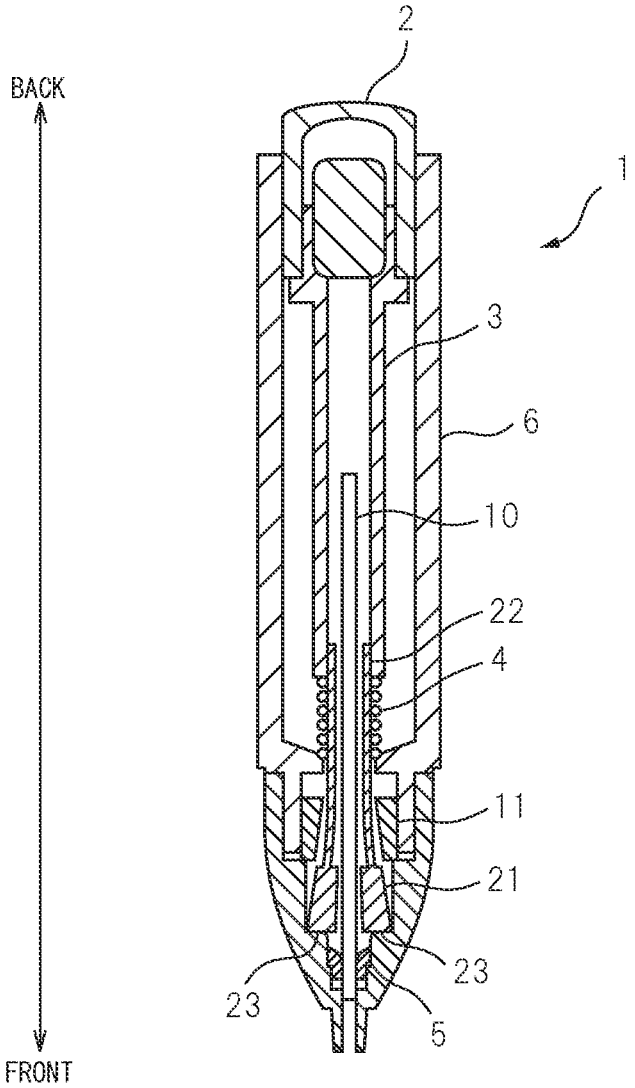
FIG. 2 is a side cross-sectional view of a mechanical pencil according to the present invention.

First, referring to FIG. 1 and FIG. 2, the setup by which lead 10 is fed out in the mechanical pencil 1 will be simply explained.

Figure 4:
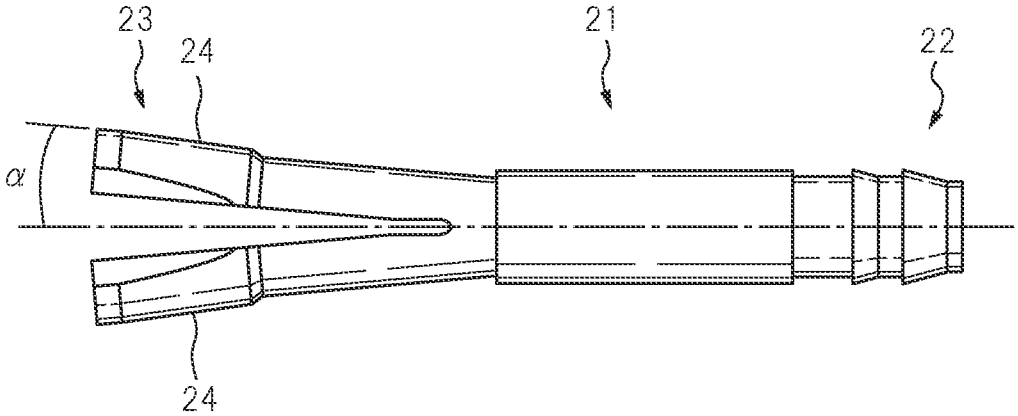
FIG. 4 is a side view of a chuck according to the present invention.

FIG. 1 and FIG. 2 are side cross-sectional views of a mechanical pencil 1 according to the present invention. The mechanical pencil 1 is comprised of, as the configuration for feeding out the lead 10, a click part 2, lead case 3, fastener 11, chuck 21, spring 4, and holding member 5. The click part 2 engages with the lead case 3. The chuck 21 has, in the longitudinal direction, an engagement end part 22 which is engaged with the lead case 3 and a split end part 23 which can be inserted into and withdrawn from the fastener 11. As shown in FIG. 4, the chuck is configured so that if the split end part 23 of the chuck 21 leaves the fastener 11, it opens. The fastener 11 is housed slidably inside the tube 6.

FIG. 1 and FIG. 2 differ in the positions of the fastener 11 and chuck 21 inside the mechanical pencil. In FIG. 1, the click part 2 is not pushed. When the click part 2 is not pushed, the chuck 21 is biased by the spring 4 to the click part 2 side through the lead case 3. That is, the split end part 23 of the chuck 21 is fastened inside of the fastener 11. At this time, the outer surface of the split end part 23 of the chuck 21 and the inner surface of the fastener 11 have complementary tapered shapes, so the split end part 23 of the chuck 21 receives drag from the fastener 11 and closes. For this reason, the lead 10 is held by the chuck 21.

On the other hand, as shown in FIG. 2, if the click part 2 is pushed, the pushing force is transmitted through the lead case 3 to the chuck 21. If the pushing force is larger than the biasing force of the spring 4, the chuck 21 advances together with the lead 10 and fastener 11. If the split end part 23 of the chuck 21 sticks out from the fastener 11, the split end part 23 opens, so the lead 10 is released from the chuck 21. At this time, the lead 10 is held by the holding member 5. After that, if the click part 2 is released, the split end part 23 of the chuck 21 enters into the fastener 11 again due to the biasing force of the spring 4, but the lead 10 is held by the holding member 5, so does not retract. By repeatedly pushing the click part 2, the lead 10 is successively fed out from the tip. In this way, the chuck 21 works with the fastener 11 to feed out and hold the lead 10. Note that, as shown in FIG. 1 and FIG. 2, in the Description, the front end of the mechanical pencil 1, that is, the tip side, is defined as the "front" side of the mechanical pencil 1, while the side opposite to the tip of the mechanical pencil 1 along the longitudinal direction of the mechanical pencil 1 is defined as the "back" side of the mechanical pencil 1.

Next, the chuck member 31 according to the present invention will be explained in detail. The chuck member 31 is comprised of a chuck 21 and a fastener 11.

Figure 3:
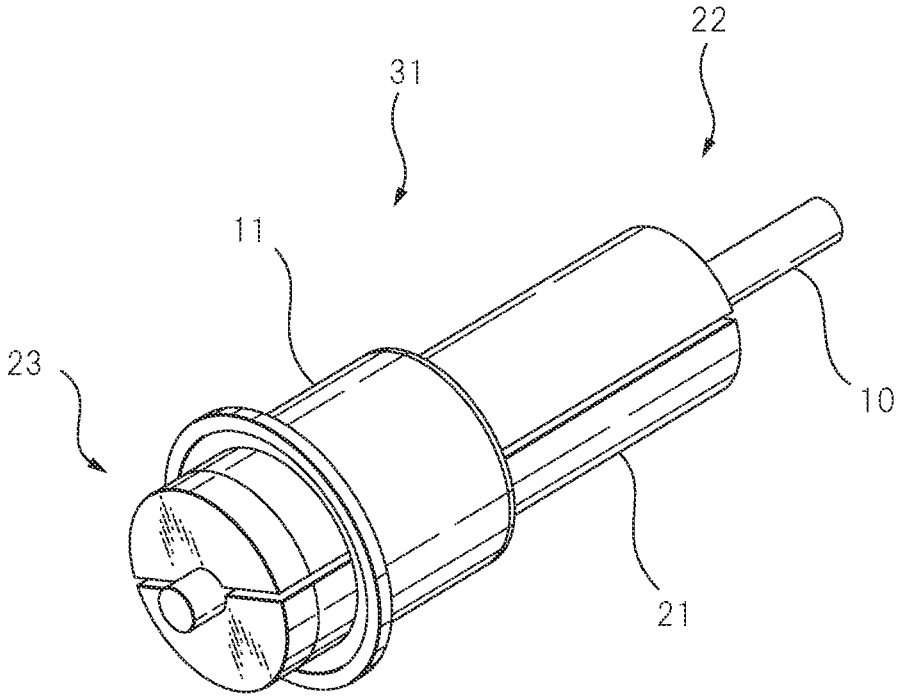
FIG. 3 is an enlarged perspective view of a chuck member according to the present invention.

FIG. 3 is an enlarged perspective view of the chuck member 31 according to the present invention. The fastener 11 has a hollow substantially cylindrical shape. The material of the fastener 11 is typically brass.

FIG. 4 is a side view of a chuck 21 according to the present invention. As shown in FIG. 4, the chuck 21 has one end part 23 in the longitudinal direction split into two symmetrically in the radial direction. This split end part 23 of the chuck 21 can be inserted into and withdrawn from the fastener 11 and has a tapered outer surface 24 which contacts the inner surface of the fastener 11 when it enters the fastener 11. The angle $\alpha$ of the tapered outer surface 24 with respect to the axial line of the chuck 21 gradually decreases when the split end part 23 of the chuck 21 is fastened inside the fastener 11. In FIG. 3, the split end part 23 of the chuck 21 closes inside the fastener 11 and holds the lead 10. Note that the split end part 23 of the chuck 21 may also be split into three sections.

Figure 5:
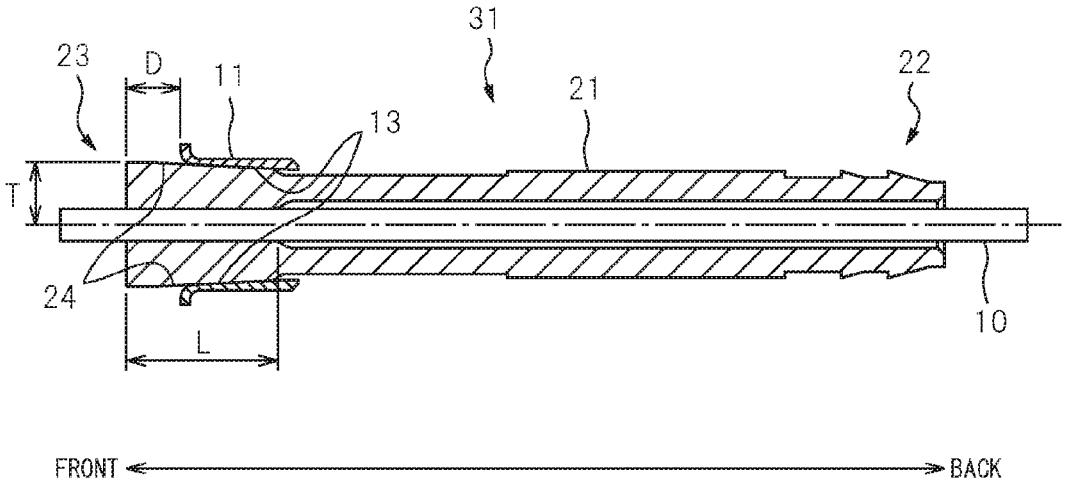
FIG. 5 is a side cross-sectional view of a chuck member according to the present invention.

FIG. 5 is a side cross-sectional view of a chuck member 31 according to the present invention. As shown in FIG. 5, the fastener 11 has a tapered inner surface 13 where a diameter of its hole gradually changes in an axial line direction. More specifically, the fastener 11 has a diameter of its hole which gradually decreases in the axial line direction toward the back. The taper angle of this tapered inner surface 13 with respect to the center axial line of the fastener 11 is about 3°. Note that, as shown in FIG. 5, in the Description, the side of the lead 10 which is held by the chuck 21 is defined as the "front" side of the chuck member 31, while the side opposite to the side of the lead 10 which is held by the chuck 21 along the longitudinal direction of the chuck member 31 is defined as the "back" side of the chuck member 31.

As shown in FIG. 5, when the split end part 23 of the chuck 21 closes inside the fastener 11 to hold the lead 10, the angle of the tapered outer surface 24 of the chuck 21 with respect to the center axial line of the chuck 21 becomes substantially equal to the angle of the tapered inner surface 13 of the fastener 11. In other words, when the split end part 23 of the chuck 21 closes inside the fastener 11 and holds the lead 10, the tapered outer surface 24 of the chuck 21 contacts the tapered inner surface 13 of the fastener 11 by a plane. Note that, as shown in FIG. 5, the center axial line of the chuck 21 and the center axial line of the fastener 11 are equal. Further, in this Description, "when the split end part 23 of the chuck 21 closes inside the fastener 11 and holds the lead 10" means the state where the lead 10 does not drop out of the chuck 21 due to gravity when the axial line direction of the lead 10 matches with the direction of gravity.

Below, a chuck member 31 according to the present invention will be explained in comparison with the prior art.

Figure 6:
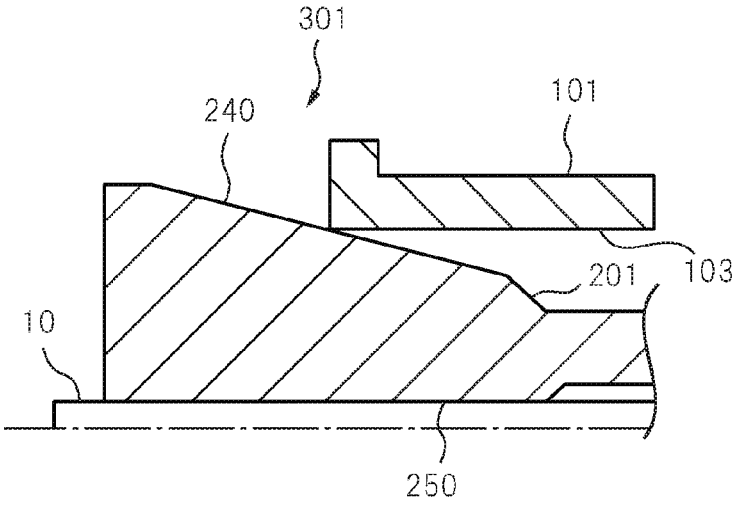
FIG. 6 is a partial side cross-sectional view of a chuck member according to the prior art.
Figure 7:
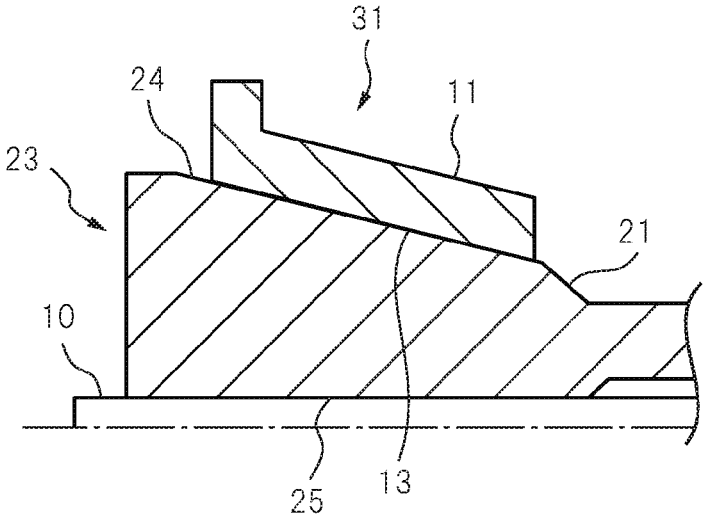
FIG. 7 is a partial side cross-sectional view of a chuck member according to the present invention.
Figure 8:
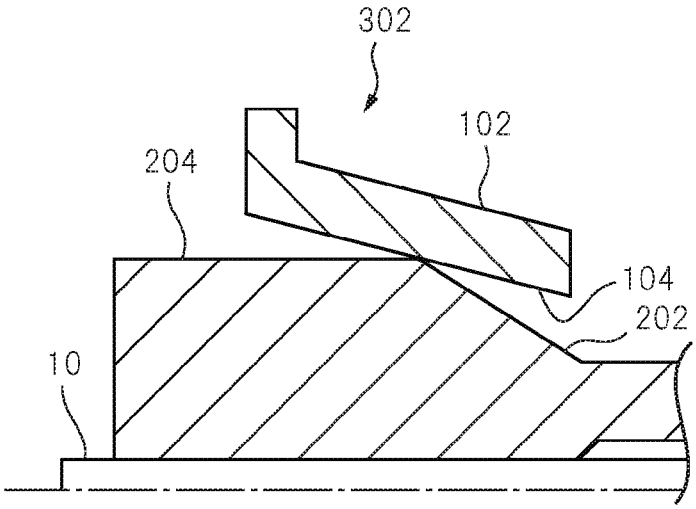
FIG. 8 is a partial side cross-sectional view of a chuck member according to the prior art.

FIG. 6 is a partial side cross-sectional view of a chuck member 301 according to the prior art. FIG. 7 is a partial side cross-sectional view of a chuck member 31 according to the present invention. The chuck members 301 and 31 have shapes which are symmetrical in the radial direction, so, for simplification, in FIG. 6 and FIG. 7, only single sides of the chuck members 301 and 31 are shown. As shown in FIG. 6, the fastener 101 according to the prior art has an inner surface 103 which extends straight in the axial line direction. For this reason, when the chuck 201 holds the lead 10, the tapered outer surface 240 of the chuck 201 contacts the inner surface 103 of the fastener 101 by a line. In this case, the contact area of the chuck 201 and the fastener 101 is small, so the chuck can easily be pushed in the fastener together with the lead and the amount of slide back of the lead becomes larger. Further, the tapered outer surface 240 of the chuck 201 locally deforms whereby deformation of the holding part 250 of the chuck 201 occurs, so the holding ability of the lead 10 becomes lower. Further, the drag from the fastener 101 is locally applied to the lead 10, so the fracture resistance of the lead 10 becomes lower. Note that, as shown in FIG. 8, a similar inconvenience occurs in the case where the outer surface 204 of the chuck 202 extends straight in the axial line direction and the inner surface 104 of the fastener 102 is a tapered shape.

On the other hand, as shown in FIG. 5 and FIG. 7, the fastener 11 according to the present invention has a tapered inner surface 13 where a diameter of its hole gradually decreases in an axial line direction toward the back. Further, the angle of the tapered outer surface 24 of the chuck 21 becomes substantially equal to the angle of the tapered inner surface 13 of the fastener 11 with respect to the center axial line of the chuck 21. For this reason, when the chuck 21 holds the lead 10, the tapered outer surface 24 of the chuck 21 contacts the tapered inner surface 13 of the fastener 11 by a plane. In this case, the contact area between the chuck 21 and the fastener 11 is large, so the chuck becomes hard to be pushed into the fastener together with the lead and the amount of slide back of the lead becomes small. Further, the drag from the inner surface of the fastener 11 is dispersed, so the local deformation of the tapered outer surface 24 of the chuck 21 is reduced and in turn the deformation of the holding part 25 of the chuck 21 is reduced. This raises the holding ability of the lead 10. Furthermore, the drag from the inner surface 13 of the fastener 11 is applied evenly to the lead 10, so the fracture resistance of the lead 10 is raised.

Below, the results of three tests relating to the lead holding ability, fracture resistance, and amount of slide back using chuck members according to the prior art and a chuck member according to the present invention are shown. In the tests, three types of chuck members according to the prior art and a chuck member according to the present invention, that is, a total of four types of samples, were used. An outline of the chucks of the chuck members which were used is shown in the following table.

TABLE 1

| | Length L of holding part (mm) | Thickness of holding part T (mm) | Material |
|---|---|---|---|
| Sample 1 (prior art) | 2.3 | 1.0 | POM (GF25%) |
| Sample 2 (prior art) | 3.5 | 1.4 | POM |
| Sample 3 (prior art) | 2.35 | 0.9 | Brass |
| Sample 4 (invention) | 2.3 | 1.0 | POM |

The holding part length L and holding part thickness T are shown in FIG. 5. The chucks of Sample 1 and Sample 2 were plastic (polyacetal (POM)) chucks according to the prior art. The chucks and fasteners were shaped as shown in FIG. 6. Note that the material of the chuck of Sample 1, that is, POM, contained glass fiber to 25%. Sample 3 was a metal (brass) chuck according to the prior art. The chuck and fastener were shaped as shown in FIG. 8. Sample 4 was a plastic (polyacetal) chuck according to the present invention. The chuck and fastener were shaped as shown in FIG. 7. The chucks of Samples 1, 3, and 4 had equal sizes, while the plastic chuck of Sample 2 was larger than the other chucks.

Lead Holding Ability Test

Figure 9:
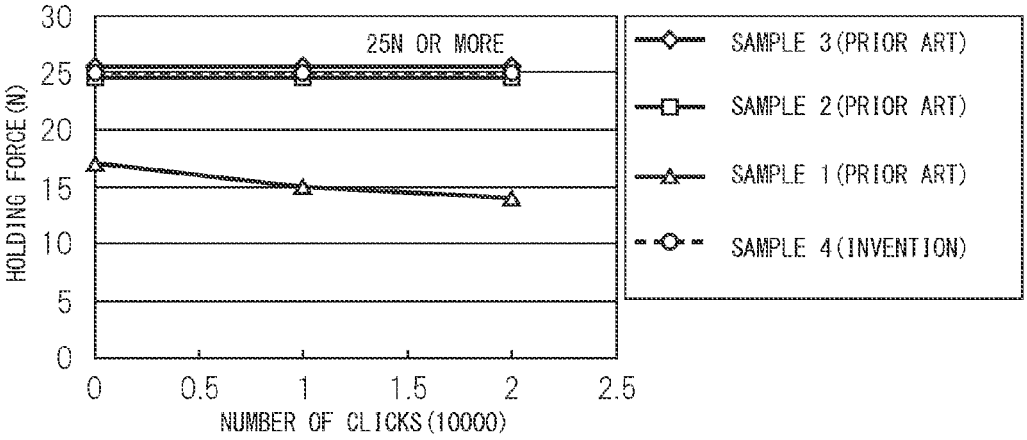
FIG. 9 is a graph which shows the results of a lead holding ability test.

In this test, the lead which was fed out from the tip was pushed against a platform scale and the load (holding force) beyond which the lead slid out from the chuck was measured. The measurement was conducted for each number of clicks. FIG. 9 is a graph which shows the result of the lead holding ability test. In the chuck member according to the prior art (Sample 1), with a less than 20N holding force, the lead slid out from the chuck. As the number of clicks increased, the holding force beyond which the lead slid out fell. In the other chuck members (Samples 2 to 4), regardless of the number of clicks, the lead did not slide out from the chuck with a 25N holding force. From this result, it was proved that the chuck member according to the present invention (Sample 4) has a high lead holding ability regardless of being a plastic chuck of a small chuck size. Note that, the holding force (N) of the ordinate of the graph of FIG. 9 expresses the load on the chuck due only to the writing pressure and does not include the biasing force of the spring. Therefore, in actuality, the chucks were subjected to a load of the holding force plus the biasing force of the spring (about 5N).

Lead Fracture Resistance Test

Figure 10:
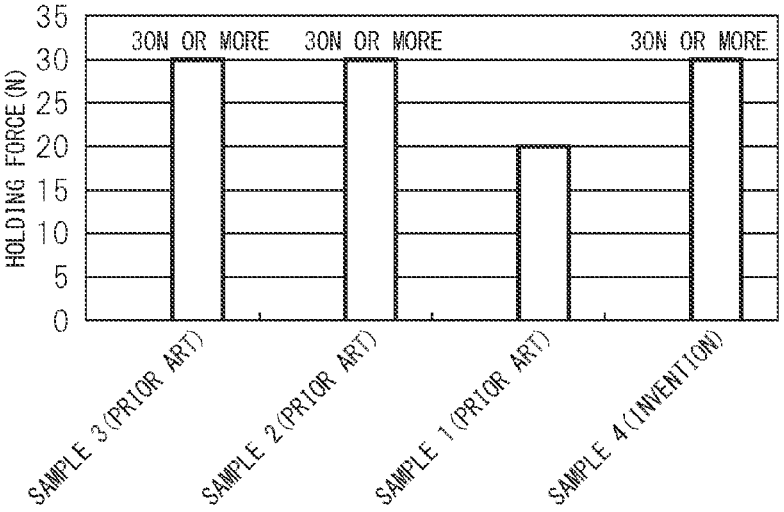
FIG. 10 is a graph which shows the results of a lead fracture resistance test.

In this test, the load (holding force) when the chuck which is inserted into the fastener was pulled backward and the lead fractured was measured. FIG. 10 is a graph which shows the results of the lead fracture resistance test. In the chuck member according to the prior art (Sample 1), the lead fractured with a 20N holding force. In the other chuck members (Samples 2 to 4), the lead did not fracture even with a 30N holding force. From this result, it was proved that the chuck member according to the present invention (Sample 4), despite the chuck being a small plastic chuck, has a high lead fracture resistance.

Lead Slide Back Amount Test

Figure 11:
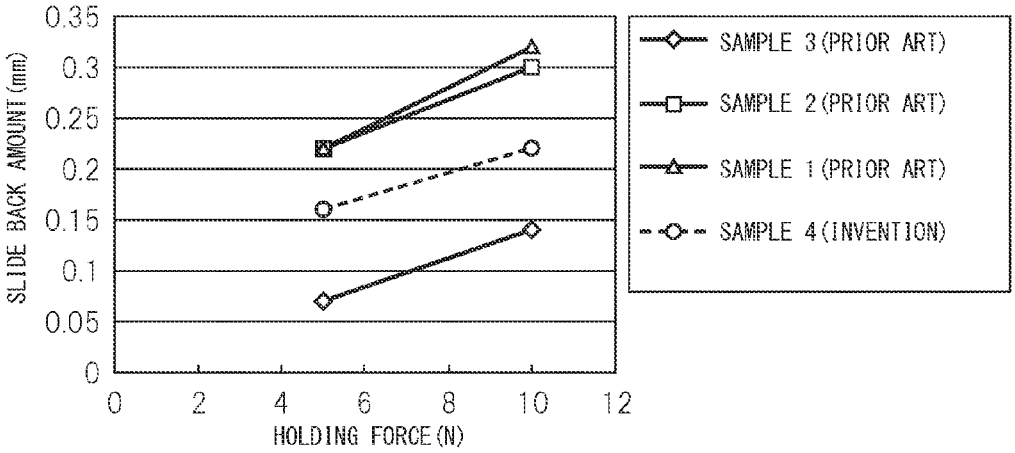
FIG. 11 is a graph which shows the results of a lead slide back amount test.

In this test, the chuck which is inserted into the fastener was pulled backward and the engagement position was measured for each load (holding force). The "engagement position" is the distance from the front end of the chuck to the front end of the fastener and is shown by the notation D in FIG. 5. The engagement position at the time of a 5N load, corresponding to the biasing force of the spring against the chuck, was used as a reference value and the difference between the reference value and the engagement position for each load was made the amount of slide back of the lead. Slide back of the lead occurs due to the the chuck which holds the lead sliding back with respect to the fastener. FIG. 11 is a graph which shows the results of the lead slide back test. The amount of slide back of the lead of the chuck member according to the present invention (Sample 4) was smaller than the amounts of slide back of the leads of the chuck members according to the prior art (Samples 1 and 2). From this result, it was proved that the chuck member according to the present invention (Sample 4), despite the chuck being a small plastic chuck, has a small lead slide back amount.

Figure 12:
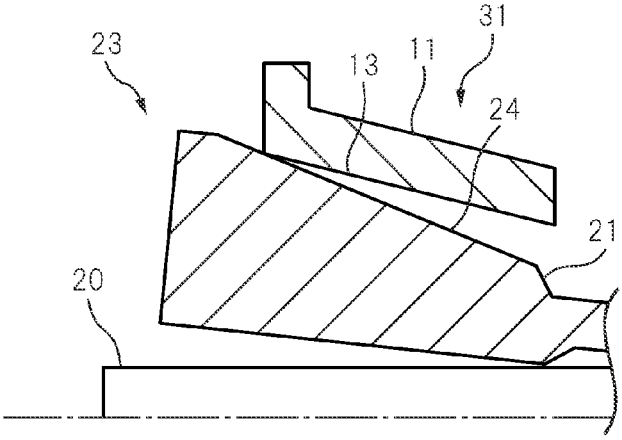
FIG. 12 is a partial side cross-sectional view of a chuck member when holding lead with a large lead diameter.
Figure 13:
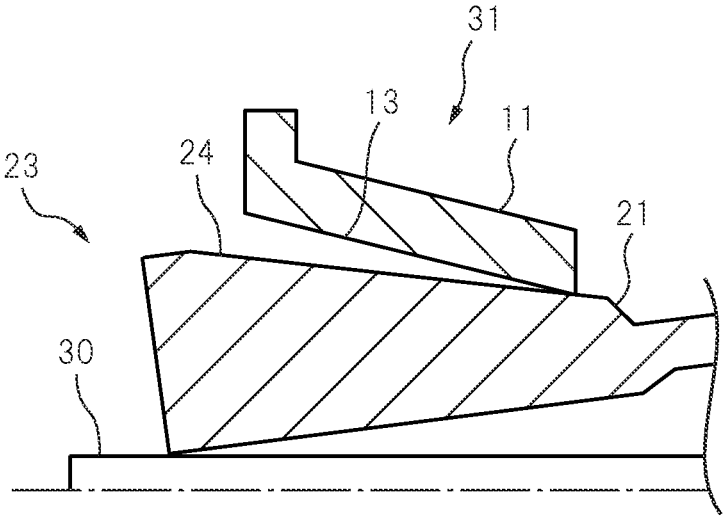
FIG. 13 is a partial side cross-sectional view of a chuck member when holding lead with a small lead diameter.

In this regard, the size of the commercially available lead which is used (lead diameter) is not always constant. Typically, the lead diameter varies by ±0.02 mm. When the lead diameter is smaller or larger than the reference value, the angle of the tapered outer surface 24 of the chuck 11 with respect to the center axial line of the chuck 11 deviates from the angle of the tapered inner surface 13 of the fastener 11 when the split end part 23 of the chuck 21 closes to hold the lead 10. FIG. 12 is a partial side cross-sectional view of a chuck member 31 when a lead 20 of a large lead diameter is held. FIG. 13 is a partial side cross-sectional view of a chuck member 31 when a lead 20 of a small lead diameter is held. For simplification, in FIG. 12 and FIG. 13, only one side of the chuck member 31 is shown.

As shown in FIG. 12, when the lead diameter is large, the back part of the split end part 23 of the chuck 21 contacts the lead 20 while the front part of the tapered outer surface 24 of the chuck 21 contacts the tapered inner surface 13 of the fastener 11. At this time, the angle of the tapered outer surface 24 of the chuck 21 deviates from the angle of the tapered inner surface 13 of the fastener 11 with respect to the center axial line of the chuck 21. In other words, the tapered outer surface 24 of the chuck 21 contacts the tapered inner surface 13 of the fastener 11 by a line. On the other hand, as shown in FIG. 13, when the lead diameter is small, the front part of the split end part 23 of the chuck 21 contacts the lead 30 while the back part of the tapered outer surface 24 of the chuck 21 contacts the tapered inner surface 13 of the fastener 11. At this time, the angle of the tapered outer surface 24 of the chuck 21 deviates from the angle of the tapered inner surface 13 of the fastener 11 with respect to the center axial line of the chuck 21. In other words, the tapered outer surface 24 of the chuck 21 contacts the tapered inner surface 13 of the fastener 11 by a line. However, this inconvenience is solved by the features of the present invention which are explained below.

The chuck 21 according to the present invention is comprised of a plastic which has elasticity. The "plastic which has elasticity" is, for example, polyacetal, nylon, polypropylene, polyethylene, etc. Due to this, both when the lead diameter is large or small, the chuck 21 will suitably deform to match with the fastener 11, so when the split end part 23 of the chuck 21 closes to hold the lead 10, the angle of the tapered outer surface 24 of the chuck 21 becomes substantially equal to the angle of the tapered inner surface 13 of the fastener 11 with respect to the center axial line of the chuck 21. Therefore, according to the chuck member 31 according to the present invention, regardless of variations in the lead diameter, a small amount of slide back of the lead and a high lead holding ability and fracture resistance can be obtained.

However, if the chuck 21 has elasticity, the edges of the both end parts of the tapered inner surface 13 of the fastener 11 in the axial line direction catch on the tapered outer surface 24 of the chuck 21 and result in poor fastening of the chuck 21 in some cases. This inconvenience is solved by the following configuration of the present invention.

Figure 14:
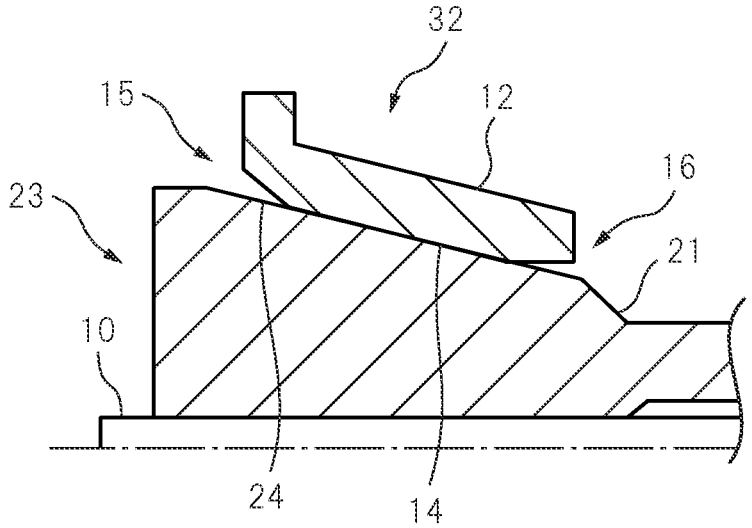
FIG. 14 is a partial side cross-sectional view of a chuck member according to another embodiment of the present invention.

FIG. 14 is a partial side cross-sectional view of a chuck member 32 according to another embodiment of the present invention. For simplification, in FIG. 14, only one side of the chuck member 32 is shown. This embodiment is configured so that the both end parts (front end part 15 and rear end part 16) of the tapered inner surface 14 of the fastener 12 in the axial line direction are away from the tapered outer surface 24 of the chuck 21 in the radial direction. More specifically, as shown in FIG. 14, the both end parts 15 and 16 of the tapered inner surface 14 of the fastener 12 in the axial line direction are chamfered to a tapered shape so as to be away from the tapered outer surface 24 of the chuck 21 in the radial direction. This chamfered shape may also be a rounded shape. Due to this configuration, the edges of the both end parts 15 and 16 of the fastener 12 are prevented from catching on the tapered outer surface 24 of the chuck 21 and in turn poor fastening of the chuck 21 is prevented.

Figure 15:
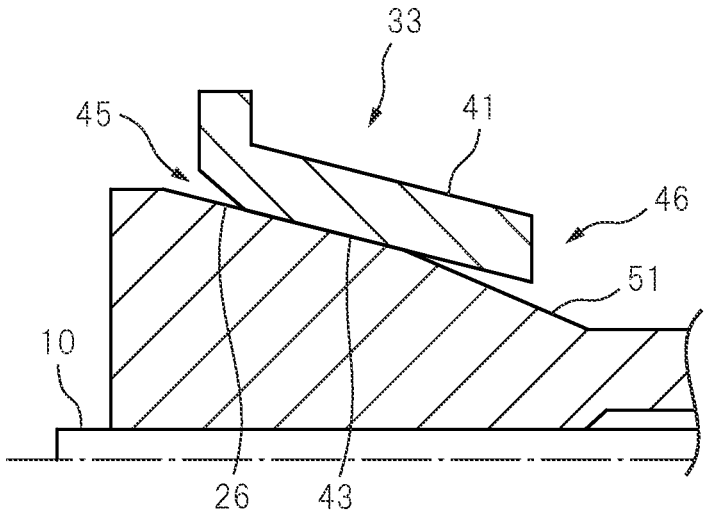
FIG. 15 is a partial side cross-sectional view of a chuck member according to still another embodiment of the present invention.

FIG. 15 is a partial side cross-sectional view of a chuck member 33 according to still another embodiment of the present invention. For simplification, in FIG. 15, only one side of the chuck member 33 is shown. This embodiment is configured so that the rear end part of the tapered outer surface 26 of the chuck 51 is away from the tapered inner surface 43 of the fastener 41 in the radial direction. Further, as shown in FIG. 15, the front end part 45 of the axial line direction of the tapered inner surface 43 of the fastener 41 is chamfered to a tapered shape so as to be away from the tapered outer surface 26 of the chuck 51 in the radial direction. This chamfered shape may be a rounded shape as well. Due to this configuration, the edges of the both end parts (front end part 45 and rear end part 46) of the fastener 41 are prevented from catching on the tapered outer surface 26 of the chuck 51 and in turn poor fastening of the chuck 51 is prevented.

Figure 16:
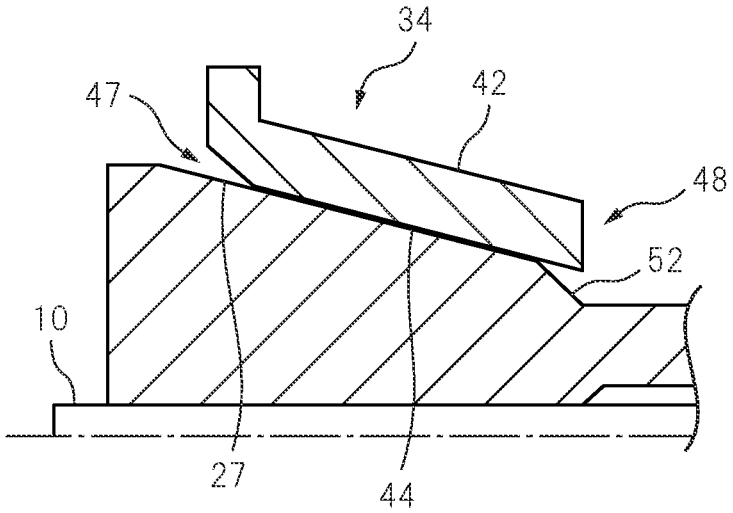
FIG. 16 is a partial side cross-sectional view of a chuck member according to still another embodiment of the present invention.

FIG. 16 is a partial side cross-sectional view of a chuck member 34 according to still another embodiment of the present invention. For simplification, in FIG. 16, only one side of the chuck member 34 is shown. In this embodiment, at the time of fastening, to prevent the rear end part of the tapered outer surface 27 of the chuck 52 from contacting the edges of the rear end part 48 of the tapered inner surface 44 of the fastener 42, the length of the fastener 42 in the axial line direction is made longer. Further, as shown in FIG. 16, the front end part 47 of the tapered inner surface 44 of the fastener 42 in the axial line direction is chamfered to a tapered shape so as to be away from the tapered outer surface 27 of the chuck 52 in the radial direction. This chamfered shape may also be a rounded shape. Due to this configuration, the edges of the both end parts 47, 48 of the fastener 42 are prevented from catching on the tapered outer surface 27 of the chuck 52 and in turn poor fastening of the chuck 52 is prevented.

Above, several preferred embodiments according to the present invention were explained, but the present invention is not limited to these embodiments. Various modifications and changes may be made within the scope of the claims. For example, the chuck may be not a plastic chuck, but a metal chuck. Further, the embodiments may be combined with each other.

REFERENCE SIGNS LIST

1 mechanical pencil
2 click part
3 lead case

4 spring
5 holding member
6 tube
10, 20, 30 lead
11, 12, 41, 42, 101, 102 fastener
13, 14, 43, 44 tapered inner surface
15, 45, 47 front end part
16, 46, 48 rear end part
21, 51, 52, 201, 202 chuck
22 engagement end part
23 split end part
24, 26, 27, 240 tapered outer surface
25, 250 holding part
31, 32, 33, 34, 301, 302 chuck member
103, 104 inner surface of fastener
204 outer surface of chuck

The invention claimed is:

1. A chuck member comprising:

a hollow substantially cylindrical shape fastener which has a tapered inner surface where a diameter of its hole gradually changes in an axial line direction and a chuck which has a split end part which is split into two or three sections, said split end part being able to be inserted into and withdrawn from said fastener and having a tapered outer surface which contacts the tapered inner surface of said fastener when entering into the fastener, wherein, when said split end part of the chuck closes inside said fastener and holds the lead, the angle of said tapered output surface of the check is equal to the angle of the tapered inner surface of said fastener with respect to the center axial line of the chuck, the chuck member is configured so that both end parts of the tapered inner surface of the fastener in the axial line direction do not contact the tapered outer surface of the chuck, and a front end part of the tapered inner surface of the fastener is chamfered.

2. The chuck member according to claim 1 wherein the chuck is comprised of a plastic which has elasticity.

3. The chuck member according to claim 1 which is configured so that the both end parts of the fastener are away from the tapered outer surface of the chuck in the radial direction.

4. A mechanical pencil which is provided with a chuck member according to claim 1.

* * * * *